US006279735B1

(12) United States Patent
Davidsson et al.

(10) Patent No.: US 6,279,735 B1
(45) Date of Patent: Aug. 28, 2001

(54) ARRANGEMENT FOR FEEDING PRODUCT CARRIERS MOVEABLY ARRANGED ON A RAIL

(75) Inventors: Mats Ingvar Davidsson, Gånghester; Dan Davidsson, Målsryd; Mikael Davidsson, Gånghester, all of (SE)

(73) Assignee: Eton Systems AB (SE)

( * ) Notice: Subject to any disclaimer, the term of this patent is extended or adjusted under 35 U.S.C. 154(b) by 0 days.

(21) Appl. No.: 09/424,381

(22) PCT Filed: May 26, 1998

(86) PCT No.: PCT/SE98/00981

§ 371 Date: Feb. 9, 2000

§ 102(e) Date: Feb. 9, 2000

(87) PCT Pub. No.: WO98/54074

PCT Pub. Date: Dec. 3, 1998

(30) Foreign Application Priority Data

May 29, 1997 (SE) ..... 9702047

(51) Int. Cl.[7] ..... B65G 47/10

(52) U.S. Cl. ..... 198/890; 198/465.4; 198/370.01; 198/860.1; 198/832

(58) Field of Search ..... 198/465.4, 370.01, 198/860.1, 861.1, 678.1, 832

(56) References Cited

U.S. PATENT DOCUMENTS 3,415,352 * 12/1968 Gerisch .
3,807,314 * 4/1974 Slemmons .
4,351,241 * 9/1982 Brems et al. ..... 104/93
5,056,438 * 10/1991 Nozaki et al. ..... 104/88.06
5,072,822 * 12/1991 Smith ..... 198/349
5,449,062 * 9/1995 McTaggart ..... 198/774.3
5,450,942 * 9/1995 Johann et al. ..... 198/465.4
5,567,386 * 10/1996 Markin ..... 422/65
5,769,949 * 6/1998 Cienkus et al. .
5,788,056 * 8/1998 Clopton ..... 198/779
5,799,769 * 9/1998 Heer et al. ..... 198/349
5,800,780 * 9/1998 Markin ..... 422/65
5,947,361 * 9/1999 Berger et al. ..... 226/92

FOREIGN PATENT DOCUMENTS 2 105 284 9/1981 (GB) .

* cited by examiner

*Primary Examiner*—Christopher P. Ellis
*Assistant Examiner*—Richard Ridley
(74) *Attorney, Agent, or Firm*—Lerner, David, Littenberg, Krumholz & Mentlik, LLP

(57) ABSTRACT

Apparatus is disclosed for feeding product carriers through a system including a first rail along which the product carriers can move, branches associated with the first rail so that the product carriers can be supplied to and removed from the first rail along the branches, an endless belt for moving the product carriers along the first rail, and a second rail disposed above the first rail, the endless belt including downwardly extending sides and being suspended from the second rail whereby the downwardly extending sides of the endless belt are accessible for driving of the endless belt thereby.

17 Claims, 8 Drawing Sheets

ARRANGEMENT FOR FEEDING PRODUCT CARRIERS MOVEABLY ARRANGED ON A RAIL

TECHNICAL FIELD

The present invention relates to an arrangement for feeding product carriers which are movably resting on a rail. Such arrangements are usually present in textile factories in connection with, for example, production of shirts wherein different cloth-pieces are suspended in a product carrier which moves on a rail to a working station, which pieces are to be sewn together at this station. The invention is however not only related to the production of shirts or the textile industry but is commonly applicable for feeding all product carriers.

PRIOR ART

The product carriers in which, for example, the cloth pieces are to be hung if they are used within the textile industry, are usually intended to roll forward on a main rail suspended from the ceiling or at a high level in the factory space. From the main rail a number of branching rails depart into which the product carriers are fed in a certain order wherein these branching rails bring the product carrier down to a lower level at a work station, wherefrom, after the cloth piece has been subjected to a working operation, the product carrier again is lifted up and fed in onto the main rail. A computer conducts the movement of the product carriers on the main rail and the branching rails and arrangements are made for transferring the product carriers to and from the branching rails. A number of work stations and branching rails are arranged along the main rail for working with the products and finally a finished product will be conveyed on the main rail and removed therefrom. The main rail and the branching rails cooperate with endless bands for driving the product carriers.

An example of such a driving band within the textile industry is described in the British patent 2105284. This band lies in a rail and drives the product carriers lying thereon, which product carriers run on two wheels. The band is made of two folded bands lying adjacent to each other, which bands are united with each other, or it can be made in one piece. The bands can be driven by means of a driving cog-wheel which engages in the folds of the band from one side. The band is flexible; it can be bent in all directions but it has nevertheless such a high rigidity that the cog-wheel both can push it forward and pull it. To make the cog-wheel engage in the folds of the band a recess is arranged in the side of the rail. The band may be long, up to several hundred meters, but it usually has a length of about fifty meters.

TECHNICAL PROBLEM

The feeding arrangements according to the prior art have as such worked well, but since the driving band for the main line lies in the main rail, this driving band is not accessible from the side but only at certain places where recesses for the driving motors have been made in the rail before mounting. Since the band lies in the rail and has its product carriers on the upper side, a rail which slopes downwardly towards the band has been arranged for feeding all product carriers. These are released by a barrier and are allowed to fall in and down on the main rail by means of gravity. When operational disturbances occur a product carrier may therefore be delayed and come in front of a later carrier than the one intended. It is therefore necessary to have a long distance between the carriers. It has therefore long been a desire to bring about a main line in which it is possible to make branchings and arrange driving motors anywhere along the line and have a synchronized in and out feeding of the product carriers, which should make it possible to have shorter distances between the carriers and consequently give the whole arrangement a higher capacity.

THE SOLUTION

To solve the above problems, an arrangement has been brought about according to the invention for feeding product carriers which are movably resting on a main rail which has branchings for supply to and removal from the main rail for product carriers, wherein the movement is intended to be carried out by means of an endless band or chain, which arrangement is characterized in that the band is movably suspended in a second rail above the main rail and is accessible for driving on the downwardly hanging sides has.

According to the invention, the band should have recesses in the sides intended to cooperate with the driving or driven cog-wheels.

According to the invention, the band shall be provided with downwardly extending carriers for movement of the product carriers in their rail.

According to the invention, change-over devices are arranged at each branching for feeding in and feeding out of the product carriers to and from the main rail, which change-over devices comprise cog-wheels which are driven by the band.

According to the invention, the cog-wheels are intended to drive an endless band for feeding or removing product carriers to and from the main rail from or to the branching rails.

According to the invention, the band is arranged close to the branching rail and comprises a plug-shaped carrier for the product carriers, which protrudes against the branching rail.

According to the invention, for coupling of the branching rails to or from the main rail, end pieces which are swingable to or from the main rail are arranged on the branching rails and swingable intermediate pieces are arrranged on the main rail adjacent to and at a level under these end pieces.

According to the invention, it is suitable that, at the branching rail for feeding product carriers to the main rail, the endpiece or the intermediate piece is swung into the correct position by means of the passing product carrier.

According to the invention, it is also suitable that at the branching rail for removing product carriers from the main rail the endpiece is swung into a correct position by means of an adjustment device while the carrier on the main band reinstalls the direct route on the main rail for the next coming product carrier.

FIGURE DESCRIPTION

The invention will in the following be described more in detail in connection with the attached drawings in which:

FIG. 1 shows a section through the driving band according to the invention with a driving cog-wheel FIG. 2 partly in section shows a main transport line with a driving band, main rail and product carriers, FIG. 3 shows the main rail with branching chains seen from above, FIG. 4 shows the same arrangement as i FIG. 3 but with a product carrier on the way in onto the main rail, FIG. 5 also shows the same arrangement as the one in FIG. 3 but with a product carrier on the way out from the main rail, FIG. 6 shows a later stage than the one according to FIG. 5, FIG. 7 shows how branchings can be obtained on both sides of the main rail and FIG. 8 shows an example of how the carrier band for the side chain can be driven by the main band.

DETAILED DESCRIPTION

FIG. 1 shows a section through the driving band 1 which consists of a folded band 2. The band consists suitably of a plastic material which makes the band 1 bendable in all directions and which enables the band to be pulled forward but also to be pushed forward. The Figure also shows a cogwheel 4 which drives the band forward. This driving band is described in more detail with regard to its construction in the British patent 2105284 but in the present case is modified in that it is made in one piece and provided with heels 3 making a flange for suspending in a gliding list.

In FIG. 2 a section through the main line is shown where the band 1 is suspended in a frame 5. The band 1 is provided with flanges 6 which are inserted in gliding lists 7 so that the band easily can be moved forwards or backwards. In the figure it is indicated how a cog-wheel 4 engages the band 1 and drives it.

As is shown in the Figure, the band hangs downwardly and carries at its lower end a number of carriers 8 arranged at even distances. These carriers 8 which are fastened to the band 1 have a box-like structure which, with its shorter side is intended to push against the product carrier 9.

The product carrier 9, which is known per se and is not part of the present invention, consists of two wheels 10 joined by a shaft 11 and having two wings 12 protruding from the hub. The wheels 10 are intended to roll on the main rail 13.

On one of the wings 12 a rod 14 is arranged, which rod has gripping organs at its lower end for gripping, for example, cloth pieces.

The carrier 8 which is attached to the driving band 1 drives the product carriers 9 by pushing them forward to abut against the wheels 10. The frame 5 which is stationary anchored to a beam or the like and which carries the driving band 1 also carries a further frame 15 which in its turn carries the main rail 13. This main rail 13 has, as is shown in the Figure, an upwardly protruding central part 16 for guidance of the wheels 10.

FIG. 3 shows how the branchings to and from the main line are arranged. The main rail 13 goes in and out from a coupling station where the main rail has a swingable intermediate part 17, a stationary intermediate part 18 and further a swingable intermediary part 19. The feeding in rail to the main rail 13 is denoted by reference numeral 20 and the feeding out rails by reference numeral 21. At the end of the feeding in rail 20 a swingable endpiece 22 is arranged and at the forward end of the feeding out rail 21 a swingable endpiece 23 is arranged. A driving wheel 24 is arranged close to the main rail 13 for driving an endless band 25 which has a carrier for carrying the product carriers on the feeding in rail 20 forward to the main rail 13. The endless band 25 runs around a free wheel 26 or a gliding list.

In the position which is shown in FIG. 3 a carrier 8 is on the band 1 on its way towards the right in the Figure pushing a product carrier 9. It appears from the Figure that the carrier 8 and the product carrier 9 will take the direct route to the right since the swingable parts 22 and 23 are swung to the side and the swingable parts 17 and 19 on the main rail 13 connect both ends thereof.

FIG. 4 shows a product carrier 9 on the way in onto the main rail 13. This product carrier 9 has come from a working station, it has been held up at a (not shown) barrier and is now on the way in onto the main rail 13. This barrier which is known per se is released in a mechanical way. The whole process of transporting the product carriers is conducted electronically by a computer. When a second (not shown) electronically conducted bar is released the driving wheel 24 starts the band 25, which band 25 has another type of carrier 27 which extends in towards the feeding-in track 20 and grips one of the adjacent wings 12 of the product carrier 9. This carrier 27 also releases the first barrier. At the entrance to the main rail 13 there is an edge 28 against which the product carrier abuts which means that the product carrier 9 will guide the swingable end-piece 22 in towards an abutment on the intermediate piece 18. Thereby, the swingable piece 17 on the main rail 13 is also pushed aside and the product carrier 9 can swing in and go forwards to the right in the Figure.

The driving wheel 24 is driven by a gear-wheel which is coupled in on the driving band 1 when the band 25 starts. This occurs simultaneously with the releasing of the above-mentioned barrier.

FIG. 5 shows a product carrier 9 which is on the way out from the main rail 13 and in onto the feeding-out rail 21. This has been made possible by swinging the swingable endpiece 23 in towards the stationary intermediate piece 18 on the main rail 13. Thereby, the product carrier 9 is guided in onto the intended branch rail 21 and pulls with it the swingable intermediate piece 19. This intermediate piece 19 lies under the swingable end-piece 23.

The swingable end-piece 23 is swung in towards the main rail 13 by means of an electric signal. This electric signal which influences a not shown arrangement not shown is guided from a computer which knows when the product carrier in question is approaching.

In the present case, no endless band 25 similar to the one which is arranged at the in-feeding rail is arranged at the rail 21. This is due to the fact that the rail 21 is intended to slope downwards and thus any carrier arrangement for this rail is unneccesary. If however the rail 21 is intended to be horizontal or to rise upwards, a band similar to the one for the feeding in shown can of course be arranged.

FIG. 6 shows how the product carrier 9 has advanced. At the same time the carrier 8 has also passed the coupling place and pushed aside the swingable end-piece 23. This has been possible since the carrier 8 has an oblique edge 29 which is intended specifically for this purpose. The swingable intermediate piece 19 on the main rail 13 has its swung out position but is forced back into a position for straight forward movement to the right by the following product carrier 9 if it is programmed to pass the branching positions.

FIG. 7 shows the same arrangement as in FIGS. 3–6 but, as appears, feeding in to the main rail 13 and removal from the main rail 13 from both sides has been arranged. The arrangement according to FIG. 7 however works in the same way as the arrangements according to FIGS. 3–6.

Finally, FIG. 8 shows how the driving band 1 is arranged above the main rail 13. A cog-wheel 30 which is driven by the band 1 is engaging the band 1. This cog-wheel 30 drives the driving-wheel 24 via a coupling 31 which couples the driving-wheel 24 to the wheel 30 driven by the band 1 when the barrier for feeding into the main rail 13 is released.

By having access to the driving band 1 from both sides at any place along its long track branching rails can be arranged in an arbitrary way along the whole track. Driving of the driving band 1 may also occur with many synchronized motors which each can be weak since they together pull the band around. This is also very important for reasons of security since if something should happen and the band is held up near one motor this will stop and when this stops all motors are influenced via the security arrangements so that the whole band will stop. No unnecessary compression or extension of the band will therefore occur. This is also of importance bearing in mind that the band can be several hundred meters long.

An advantage with this open driving band is also that all branchings can be driven by this band via change-over devices as shown above.

The invention is not limited to the embodiment shown but it can be varied in different ways within the scope of the claims.

What is claimed is:

1. Apparatus for feeding a plurality of product carriers comprising a first rail for said plurality of product carriers whereby said plurality of product carriers can move along said first rail, a plurality of branches associated with said first rail whereby said plurality of product carriers can be supplied to and removed from said first rail along said plurality of branches, an endless belt for moving said plurality of product carriers along said first rail, and a second rail disposed above said first rail, said endless belt including downwardly extending sides, and being suspended from said second rail whereby said downwardly extending sides of said endless belt are displaced below said second rail, which does not interfere with the accessibility of said endless belt for driving thereby.

2. The apparatus according to claim 1 wherein said downwardly extending sides of said endless belt include recesses, whereby said endless belt may be driven by cooperation of said recesses with a driving member.

3. The apparatus of claim 1 wherein said endless belt includes downwardly extending carrier means, whereby said plurality of product carriers can be moved along said first rail by means of said downwardly extending carrier means.

4. The apparatus of claim 1 wherein said plurality of branches includes at least one feeding-in branch for feeding at least one of said plurality of product carriers onto said first rail at a first point and at least one feeding-out branch for removing at least one of said plurality of product carriers from said first rail at a second point, and changeover means disposed at said first and second points, said changeover means including cog wheels driven by said endless belt for synchronizing said feeding of said at least one of said plurality of product carriers onto said first rail and said removing of said at least one of said plurality of product carriers from said first rail.

5. The apparatus of claim 4 including a first endless band for feeding said at least one product carrier onto said first rail and a second endless band for removing said at least one product carrier from said first rail, said cog wheels driving said first and second endless bands.

6. The apparatus of claim 5 wherein said first endless band is disposed adjacent to said at least one feeding-in branch and said first endless band includes a carrier member protruding from said first endless band towards said at least one feeding-in band for interacting with said at least one product carrier.

7. The apparatus of claim 6 wherein said carrier member is plug shaped.

8. The apparatus of claim 1 including coupling means for coupling said first rail to at least one of said plurality of branches, said coupling means including at least one end piece associated with said at least one of said plurality of branches, said at least one end piece being swingable between a first position distal from said first rail and a second position proximate to said first rail whereby said plurality of product carriers can be supplied to or removed from said first rail when said at least one end piece is in said second position, and at least one intermediate first rail portion located on said first rail adjacent to said at least one end piece, said at least one intermediate first rail portion being swingable between a first position in line with said first rail when said at least one end piece is in said first position and a second position out of line with said first rail when said at least one end piece is in said second position.

9. The apparatus of claim 8 wherein said at least one of said plurality of branches comprises a feeding-in branch for feeding at least one of said plurality of product carriers to said first rail, whereby one of said plurality of product carriers moving along said first rail causes said at least one end piece and said at least one intermediate first rail portion to swing into said second position.

10. The apparatus of claim 8 wherein said at least one of said plurality of branches comprises a feeding-out branch for removing at least one of said plurality of product carriers from said first rail, and including adjustment means for swinging said at least one end piece into said second position, whereby one of said plurality of product carriers moving along said first rail causes said at least one intermediate rail portion and said at least one end piece to swing into said first position.

11. Apparatus for feeding a plurality of product carriers comprising a first rail for said plurality of product carriers whereby said plurality of product carriers can move along said first rail, a plurality of branches associated with said first rail whereby said plurality of product carriers can be supplied to and removed from said first rail along said plurality of branches, said plurality of branches including at least one feeding-in branch for feeding at least one of said plurality of product areas onto said first rail at a first point and at least one feeding-out branch for removing at least one of said plurality of product carriers from said first rail at a second point, an endless belt for moving said plurality of product carriers along said first rail, a second rail disposed above said first rail, said endless belt including downwardly extending sides, and being suspended from said second rail whereby said downwardly extending sides of said endless belt are accessible for driving of said endless belt thereby, and changeover means disposed at said first and second points, said changeover means including cartwheels driven by said endless belt for synchronizing said feeding of said at least one of said plurality of product carriers onto said first rail and said removing of said at least one of said plurality of product carriers from said first rail.

12. The apparatus of claim 11, including a first endless band for feeding said at least one product carrier onto said first rail and a second endless band for removing said at least one product carrier from said first rail, said cog wheels driving said first and second endless bands.

13. The apparatus of claim 12, wherein said first endless band is disposed adjacent to said at least one feeding-in branch and said first endless band includes a carrier member protruding from said first endless band towards said at least one feeding-in band for interacting with said at least one product carrier.

14. The apparatus of claim 13, wherein said carrier member is plug shaped.

15. Apparatus for feeding a plurality of product carriers comprising a first rail for said plurality of product carriers whereby said plurality of product carriers can move along said first rail, a plurality of branches associated with said first rail whereby said plurality of product carriers can be supplied to and removed from said first rail along said plurality of branches, an endless belt for moving said plurality of product carriers along said first rail, a second rail disposed above said first rail, said endless belt including downwardly extending sides, and being suspended from said second rail whereby said downwardly extending sides of said endless belt are accessible for driving of said endless belt thereby, coupling means for coupling said first rail to at least one of said plurality of branches, said coupling means including at least one end piece associated with said at least one of said plurality of branches, said at least one end piece being swingable between a first position distal from said first rail and a second position proximate to said first rail whereby said plurality of product carriers can be supplied to or removed from said first rail when said at least one end piece is in said second position, and at least one intermediate first rail portion located on said first rail adjacent to said at least one end piece, said at least one intermediate first rail portion being swingable between a first position in line with said first rail when said at least one end piece is in said first position and a second position out of line with said first rail when said at least one end piece is in said second position.

16. The apparatus of claim 15 wherein said at least one of said plurality of branches comprises a feeding-in branch for feeding at least one of said plurality of product carriers to said first rail, whereby one of said plurality of product carriers moving along said first rail causes said at least one end piece and said at least one intermediate first rail portion to swing into said second position.

17. The apparatus of claim 15 wherein said at least one of said plurality of branches comprises a feeding-out branch for removing at least one of said plurality of product carriers from said first rail, and including adjustment means for swinging said at least one end piece into said second position, whereby one of said plurality of product carriers moving along said first rail causes said at least one intermediate rail portion and said at least one end piece to swing into said first position.

* * * * *

UNITED STATES PATENT AND TRADEMARK OFFICE

CERTIFICATE OF CORRECTION

PATENT NO. : 6,279,735 B1
DATED : August 28, 2001
INVENTOR(S) : Mats Ingvar Davidsson et al.

It is certified that error appears in the above-identified patent and that said Letters Patent is hereby corrected as shown below:

Delete columns 1-8 and substitute therefore columns 1-8 as shown on the attached pages.

Signed and Sealed this

Sixth Day of May, 2003

JAMES E. ROGAN
*Director of the United States Patent and Trademark Office*

ARRANGEMENT FOR FEEDING PRODUCT CARRIERS MOVEABLY ARRANGED ON A RAIL

FIELD OF THE INVENTION

The present invention relates to apparatus for feeding product carriers which are movably resting on a rail. Such apparatus is usually present in textile factories, such as in connection with the production of shirts wherein different cloth-pieces are suspended in a product carrier which moves on a rail to a working station, at which these pieces are to be sewn together. The present invention is not only related to the production of shirts, to or the textile industry, but is also commonly applicable for feeding all types of product carriers.

BACKGROUND OF THE INVENTION

Product carriers, such as those in which cloth pieces are to be hung for us within the textile industry, are usually intended to roll forward on a main rail, which is suspended from the ceiling, or at a high level in the factory space. From the main rail a number of branch rails depart, and the product carriers can then be fed with these branches in a certain order whereby these branching rails bring the product carrier down to a lower level at a work station. After the cloth piece has then been subjected to a working operation, the product carrier is again lifted up and fed back onto the main rail. A computer generally conducts the movement of the product carriers on the main rail and the branching rails, and arrangements are then made for transferring the product carriers to and from the branching rails. A number of work stations and branching rails are arranged along the main rail for working with the products, and finally a finished product will be conveyed onto the main rail and removed therefrom. The main rail and the branching rails cooperate with endless bands for driving the product carriers.

An example of such a driving band within the textile industry is described in British Patent No. 2,105,284. This band lies within a rail, and drives the product carriers lying thereon, which product carriers run on two wheels. The band is composed of two folded bands lying adjacent to each other, which bands are united with each other, or it can be made in one piece. The bands can be driven by means of a driving cogwheel which engages in the folds of the band from one side. The band is flexible, so that it can be bent in all directions, but it nevertheless has such a high rigidity that the cog-wheel can both push it forward and pull it. To make the cog-wheel engage in the folds of the band a recess is arranged in the side of the rail. The band may be long, such as up to several hundred meters, but it usually has a length of about fifty meters.

These feeding arrangements according to the prior art have worked fairly well, but since the driving band for the main line lies within the main rail, this driving band is not accessible from the side, but only at certain locations where recesses for the driving motors have been made in the rail before mounting. Since the band lies in the rail and has its product carriers on the upper side, a rail which slopes downwardly towards the band is utilized for feeding all of the product carriers. These are released by a barrier and are allowed to fall in and down onto the main rail by means of gravity. When operational disturbances occur, a product carrier may therefore be delayed and come in front of a later carrier than the one intended. It is therefore necessary to have a relatively long distance between the carriers. It has therefore been desirous for a long time to provide a main line in which it is possible to make branchings and arrange driving motors anywhere along the line, and have synchronized feeding and removal of the product carriers, which should make it possible to have shorter distances between the carriers and consequently provide the whole arrangement with a higher capacity.

SUMMARY OF THE INVENTION

In accordance with the present invention, these and other objects have now been realized by the invention of apparatus for feeding a plurality of product carriers comprising a first rail for the plurality of product carriers whereby the plurality of product carriers can move along the first rail, a plurality of branches associated with the first rail whereby the plurality of product carriers can be supplied to and removed from the first rail along the plurality of branches, an endless belt for moving the plurality of product carriers along the first rail, and a second rail disposed above the first rail, the endless belt including downwardly extending sides, and being suspended from the second rail whereby the downwardly extending sides of the endless belt are accessible for driving of the endless belt thereby. In accordance with a preferred embodiment, the downwardly extending sides of the endless belt include recesses, whereby the endless belt may be driven by cooperation of the recesses with a driving member.

In accordance with one embodiment of the apparatus of the present invention, the endless belt includes downwardly extending carrier means, whereby the plurality of product carriers can be moved along the first rail by means of the downwardly extending carrier means.

In accordance with one embodiment of the apparatus of the present invention, the plurality of branches includes at least one feeding-in branch for feeding at least one of the plurality of product carriers onto the first rail at a first point and at least one feeding-out branch for removing at least one of the plurality of product carriers from the first rail at a second point, and changeover means disposed at the first and second points, the changeover means including cog wheels driven by the endless belt for synchronizing the feeding of the at least one of the plurality of product carriers onto the first rail and the removing of the at least one of the plurality of product carriers from the first rail. In a preferred embodiment, the apparatus includes a first endless band for feeding the at least one product carrier onto the first rail and a second endless band for removing the at least one product carrier from the first rail, the cog wheels driving the first and second endless bands. In accordance with a preferred embodiment, the first endless band is disposed adjacent to the at least one feeding-in branch and the first endless band includes a carrier member protruding from the first endless band towards the at least one feeding-in band for interacting with the at least one product carrier. Preferably, the carrier member is plug shaped.

In accordance with another embodiment of the apparatus of the present invention, the apparatus includes coupling means for coupling the first rail to at least one of the plurality of branches, the coupling means including at least one end piece associated with the at least one of the plurality of branches, the at least one end piece being swingable between a first position distal from the first rail and a second position proximate to the first rail whereby the plurality of product carriers can be supplied to or removed from the first rail when the at least one end piece is in the second position, and at least one intermediate first rail portion located on the first rail adjacent to the at least one end piece, the at least one intermediate first rail portion being swingable between a first position in line with the first rail when the at least one end piece is in the first position and a second position out of line with the first rail when the at least one end piece is in the second position. In a preferred embodiment, the at least one of the plurality of branches comprises a feeding-in branch for feeding at least one of the plurality of product carriers to the first rail, whereby one of the plurality of product carriers moving along the first rail causes the at least one end piece and the at least one intermediate first rail portion to swing into the second position.

In accordance with another embodiment of the apparatus of the present invention, at least one of the plurality of branches comprises a feeding-out branch for removing at least one of the plurality of product carriers from the first rail, and including adjustment means for swinging the at least one end piece into the second position, whereby one of the plurality of product carriers moving along the first rail causes the at least one intermediate rail portion and the at least one end piece to swing into the first position.

To solve the above problems, apparatus has been devised for feeding product carriers which are movably resting on a main rail which has branches for supply to and removal from the main rail of product carriers, wherein the movement is intended to be carried out by means of an endless band or chain. In accordance with this apparatus, the band is movably suspended in a second rail above the main rail and is accessible for driving on the downwardly hanging sides thereof.

According to the present invention, the band has recesses in its sides intended to cooperate with the driving or driven cog-wheels.

According to the present invention, the band is provided with downwardly extending carriers for movement of the product carriers along the rail.

According to the present invention, change-over devices are arranged at each branch for feeding in and feeding out of the product carriers to and from the main rail, which change-over devices comprise cog-wheels which are driven by the band.

According to the present invention, the cog-wheels are intended to drive an endless band for feeding or removing product carriers to and from the main rail from or to the branch rails.

According to the present invention, the band is arranged close to the branch rail and comprises a plug-shaped carrier for the product carriers, which protrudes against the branch rail.

According to the present invention, for coupling of the branch rails to or from the main rail, end pieces which are swingable to or from the main rail are arranged on the branch rails, and swingable intermediate pieces are arranged on the main rail adjacent to and at a level under these end pieces.

According to the present invention, at the branch rail for feeding product carriers to the main rail, the endpiece or the intermediate piece can be swung into the correct position by means of the passing product carrier.

According to the present invention, it is also possible that, at the branch rail for removing product carriers from the main rail, the endpiece is swung into a correct position by means of an adjustment device, while the product carrier on the main band reinstalls the direct route on the main rail for the next arriving product carrier.

BRIEF DESCRIPTION OF THE DRAWINGS

The present invention will be more fully appreciated by reference to the following detailed description, which refers to the attached drawings, in which.

DETAILED DESCRIPTION

Figure 1:
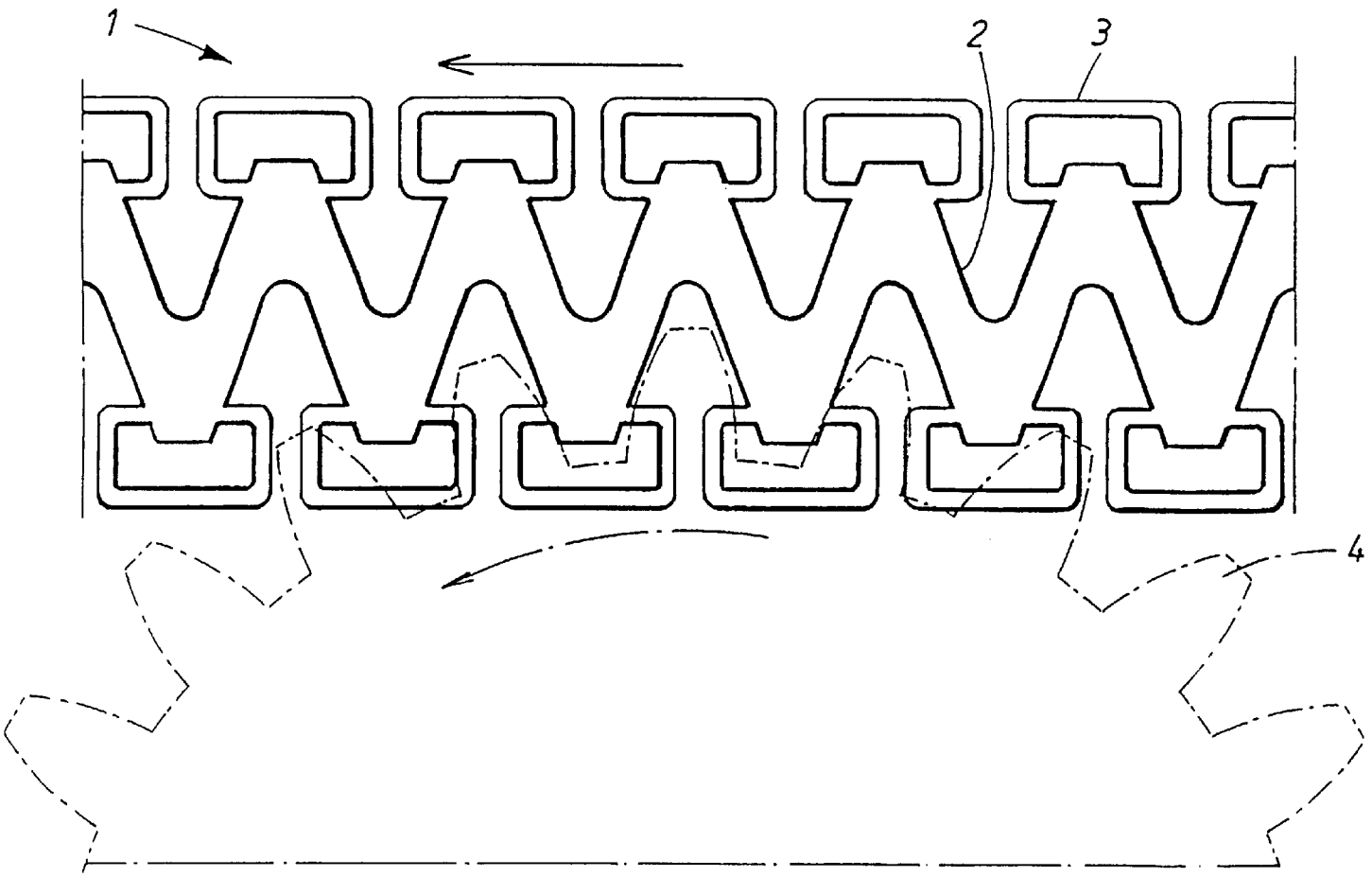
FIG. 1 is a top, elevational, sectional view through the driving band according to the present invention with a driving cog-wheel therefor.

FIG. 1 shows a sectional view taken through the driving band 1 which consists of a folded band 2. The band preferably consists of a plastic material which makes the band 1 bendable in all directions and which enables the band to be pulled forward, as well as to be pushed forward. FIG. 1 also shows a cog-wheel 4 which drives the band forward. This driving band is described in more detail with regard to its construction in British Patent No. 2,105,284 but in the present case is modified in that it is made in one piece and is provided with heels 3 making a flange for suspending in a gliding list.

Figure 2:
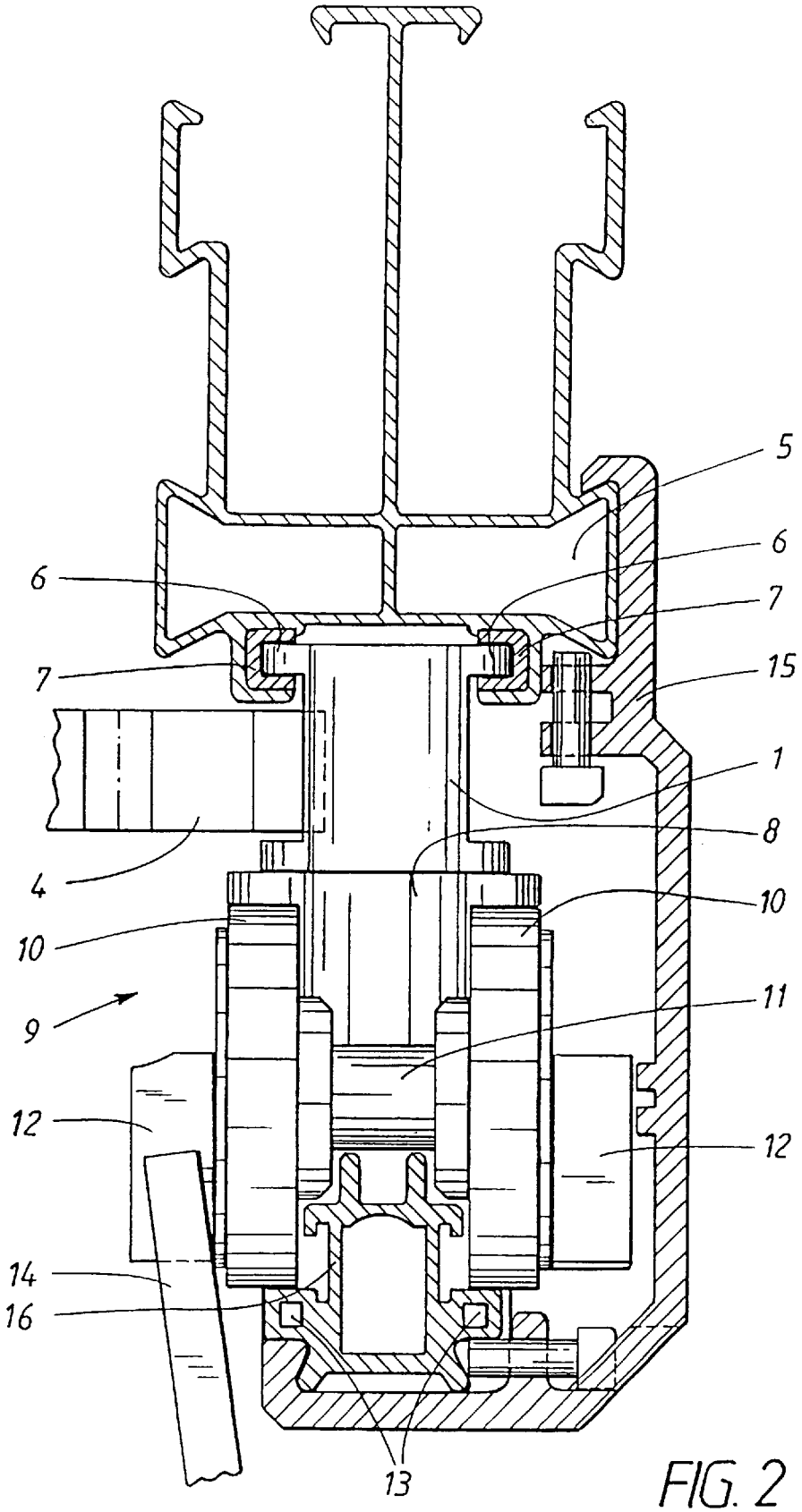
FIG. 2 is a front, elevational, partly sectional view of a main transport line with a driving band, main rail and product carriers according to the present invention.

In FIG. 2 there is shown a sectional view through the main line where the band 1 is suspended in a frame 5. The band 1 is provided with flanges 6 which are inserted in gliding lists 7 so that the band can be easily moved forwards or backwards. In the figure it can be seen how a cog-wheel 4 engages the band 1 and drives it.

As is shown in FIG. 2, the band hangs downwardly and carries at its lower end a number of carriers 8 arranged at even distances. These carriers 8, which are fastened to the band 1 have a box-like structure which, with its shorter side is intended to push against the product carrier 9.

The product carrier 9, which is known per se and is not part of the present invention, consists of two wheels 10 joined by a shaft 11 and having two wings 12 protruding from the hub. The wheels 10 are intended to roll on the main rail 13.

On one of the wings 12 is arranged a rod 14, which rod has gripping organs at its lower end for gripping, for example, cloth pieces.

The carrier 8 which is attached to the driving band 1 drives the product carriers 9 by pushing them forward to abut against the wheels 10. The frame 5 which is stationarily anchored to a beam or the like, and which carries the driving band 1, also carries a further frame 15 which in turn carries the main rail 13. This main rail 13 has, as is shown in the Figure, an upwardly protruding central part 16 for guidance of the wheels 10.

Figure 3:
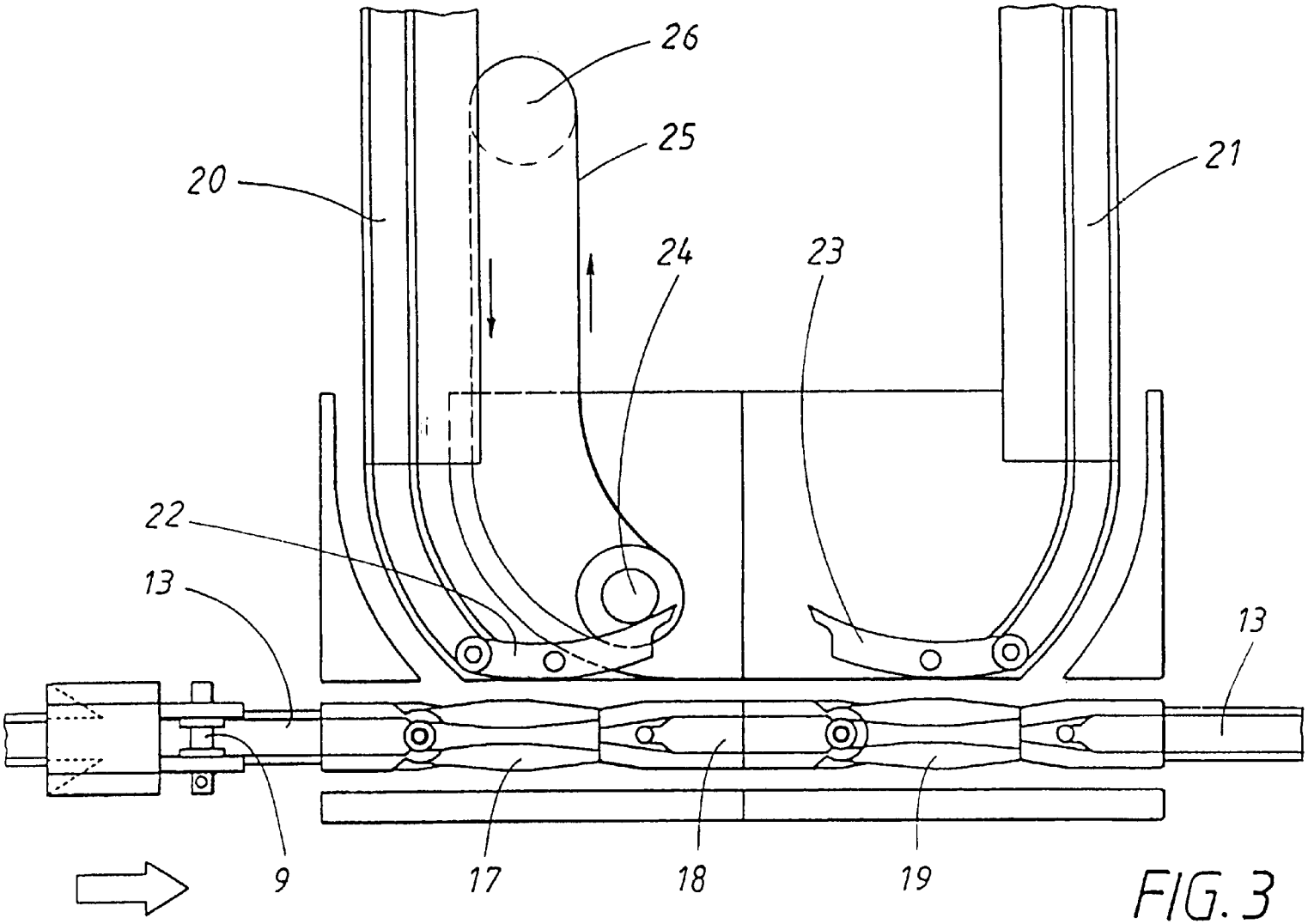
FIG. 3 is a top, elevational, partially schematic view of a main rail with branch rails associated therewith.

FIG. 3 shows how the branches to and from the main line are arranged. The main rail 13 enters and exits from a coupling station where the main rail has a further swingable intermediate part 17, a stationary intermediate part 18 and a swingable intermediary part 19. The feeding in rail to the main rail 13 is denoted by reference numeral 20 and the feeding out rails are indicated by reference numeral 21. At the end of the feeding in rail 20 a swingable endpiece 22 is arranged and at the forward end of the feeding out rail 21 a swingable endpiece 23 is arranged. A driving wheel 24 is arranged close to the main rail 13 for driving an endless band 25 which has a carrier for carrying the product carriers on the feeding in rail 20 forward to the main rail 13. The endless band 25 runs around a free wheel 26 or a gliding list.

In the position shown in FIG. 3 a carrier 8 on band 1 is on its way towards the right in the Figure, pushing a product carrier 9. It appears from the Figure that the carrier 8 and the product carrier 9 will take the direct route to the right, since the swingable parts 22 and 23 are swung to the side, and the swingable parts 17 and 19 on the main rail 13 connect both ends thereof.

Figure 4:
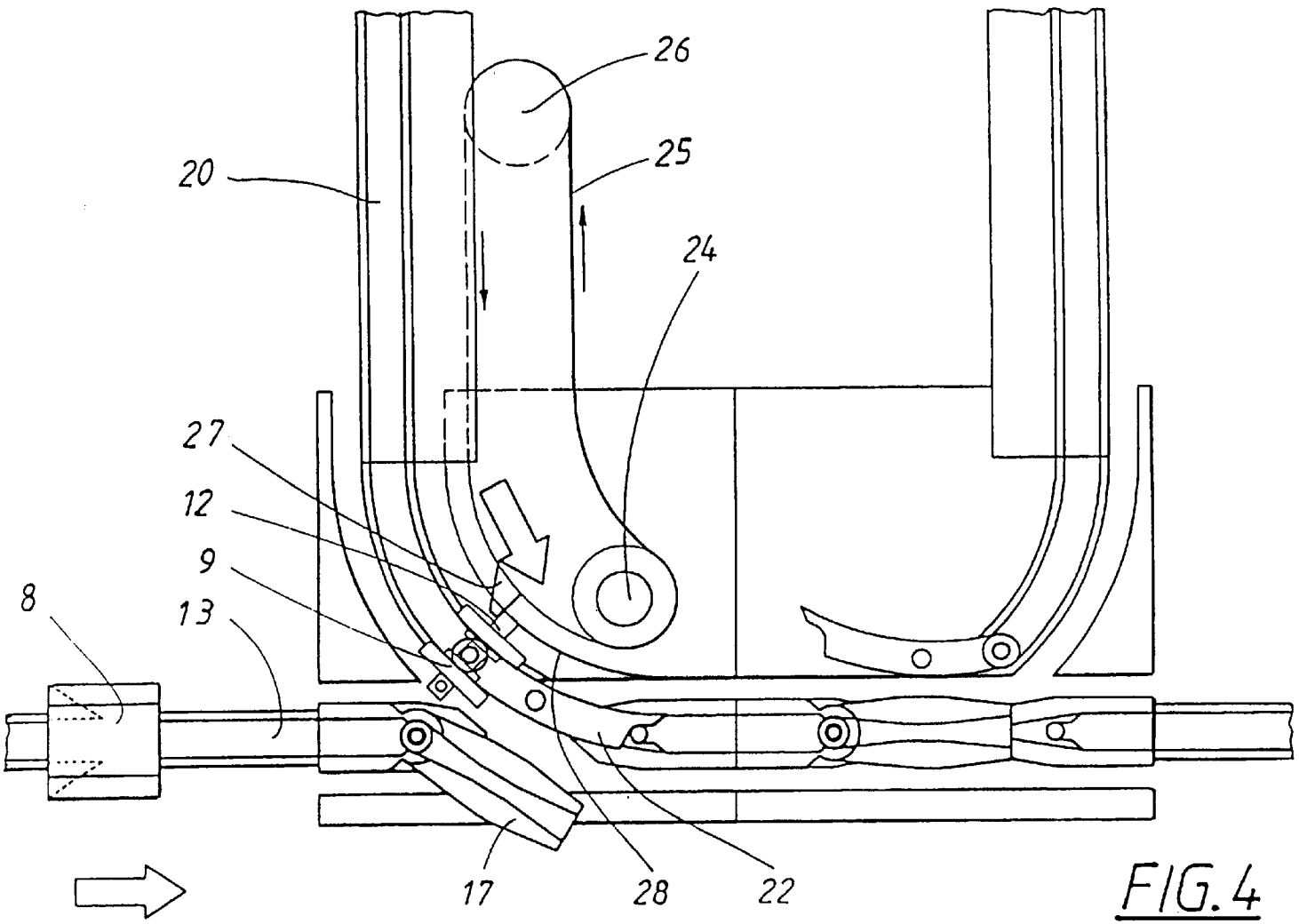
FIG. 4 is a top, elevational, partially schematic view as shown in FIG. 3, but with a product carrier passing onto the main rail.

FIG. 4 shows a product carrier 9 on the way onto the main rail 13. This product carrier 9 has arrived from a working station, and it has been held up at a (not shown) barrier and is now on the way onto the main rail 13. This barrier which is known per se, is released in a mechanical way. The whole process of transporting the product carriers is conducted electronically by a computer. When a second (not shown) electronically conducted bar is released, the driving wheel 24 starts the band 25, which has another type of carrier 27 which extends in towards the feeding-in track 20 and grips one of the adjacent wings 12 of the product carrier 9. This carrier 27 also releases the first barrier. At the entrance to the main rail 13 there is an edge 28 against which the product carrier abuts, such that the product carrier 9 will guide the swingable end-piece 22 in towards an abutment on the intermediate piece 18. In this manner, the swingable piece 17 on the main rail 13 is also pushed aside, and the product carrier 9 can swing in and move towards the right in this Figure.

The driving wheel 24 is driven by a gear-wheel which is coupled to the driving band 1 when the band 25 starts. This occurs simultaneously with release of the above-mentioned barrier.

Figure 5:
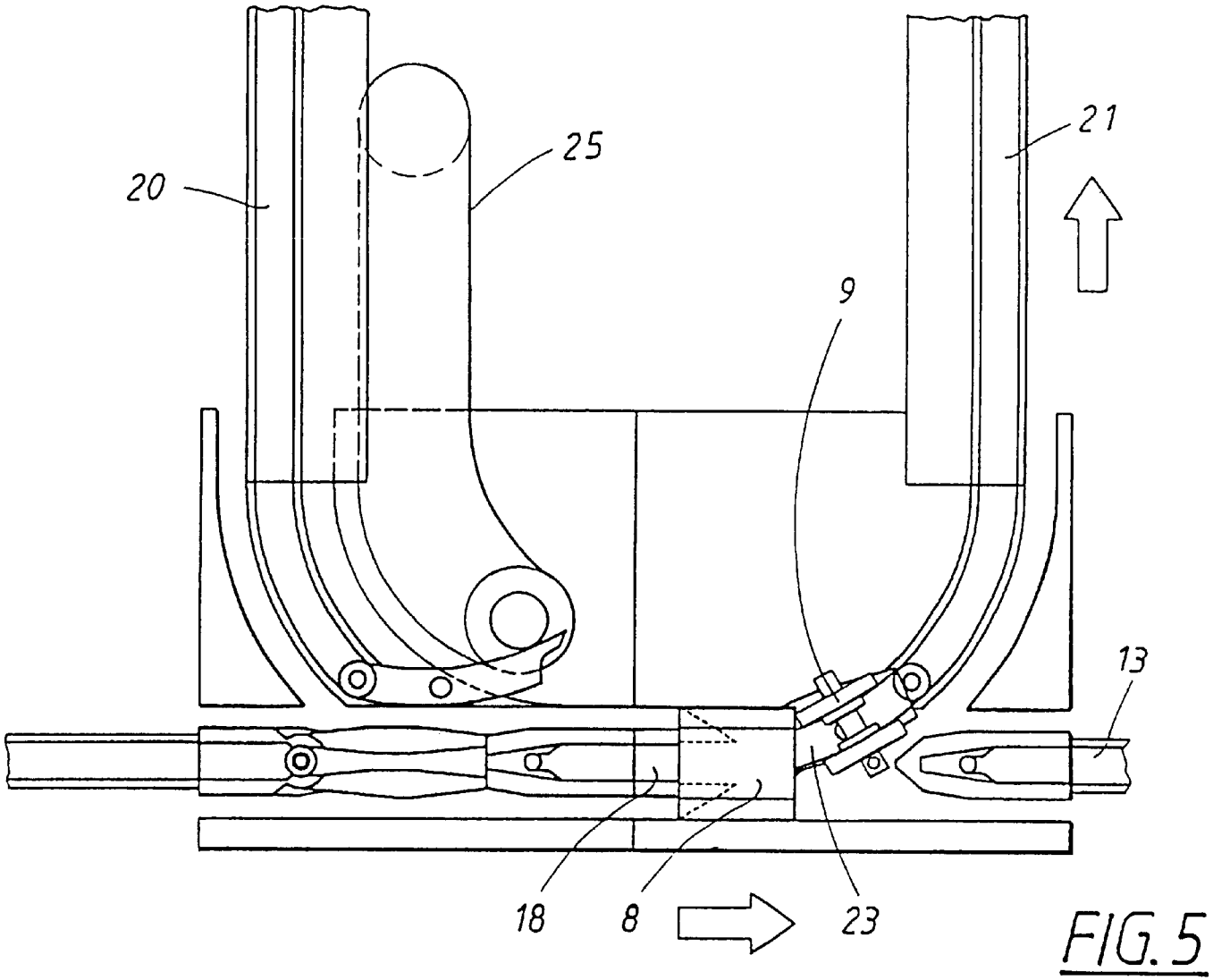
FIG. 5 is a top, elevational, partially schematic view as shown in FIG. 3, but with a product carrier passing out of the main rail.

FIG. 5 shows a product carrier 9 which is exiting from the main rail 13 and onto the feeding-out rail 21. This has been made possible by swinging the swingable end-piece 23 in towards the stationary intermediate piece 18 on the main rail 13. In this manner, the product carrier 9 is guided onto the intended branch rail 21 and pulls with it the swingable intermediate piece 19. This intermediate piece 19 lies under the swingable end-piece 23.

The swingable end-piece 23 is swung in towards the main rail 13 by means of an electric signal. This electric signal, which influences an arrangement (not shown) is guided from a computer which senses when the product carrier in question is approaching.

In the present case, no endless band 25 similar to the one which is arranged at the in-feeding rail is arranged at the rail 21. This is due to the fact that the rail 21 is intended to slope downwards, and thus any carrier arrangement for this rail is unnecessary. If, however, the rail 21 is intended to be horizontal or to rise upwards, a band similar to the one shown for the feeding in can be arranged.

Figure 6:
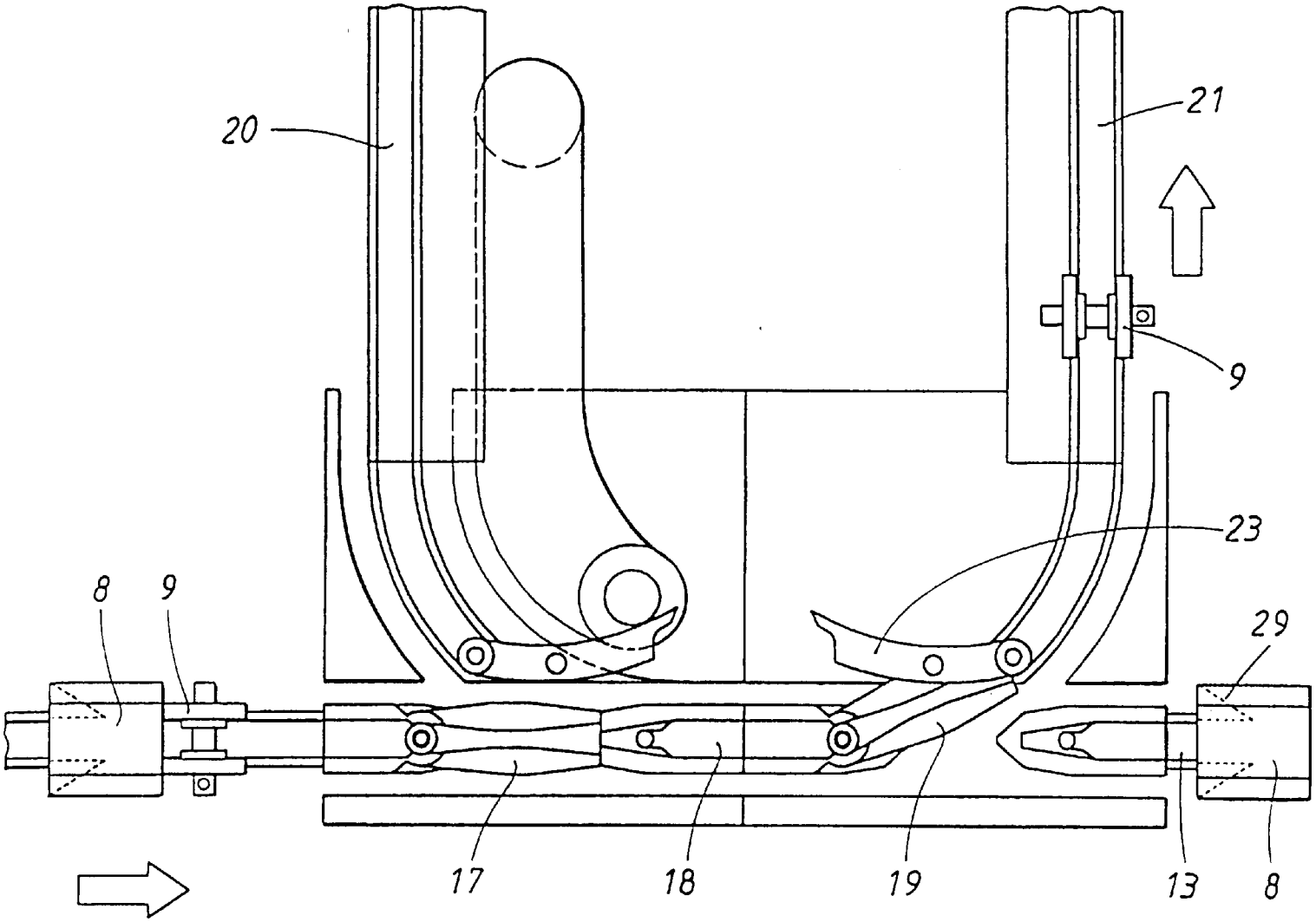
FIG. 6 is a top, elevational, partially schematic view as shown in FIG. 3 at a later stage than the configuration according to FIG. 5.

FIG. 6 shows how the product carrier 9 has advanced. At the same time, the carrier 8 has also passed the coupling place and pushed aside the swingable endpiece 23. This has been possible since the carrier 8 has an oblique edge 29 which is intended specifically for this purpose. The swingable intermediate piece 19 on the main rail 13 has its swung out position, but is forced back into a position for straight forward movement to the right by the following product carrier 9 if it is programmed to pass the branching locations.

Figure 7:
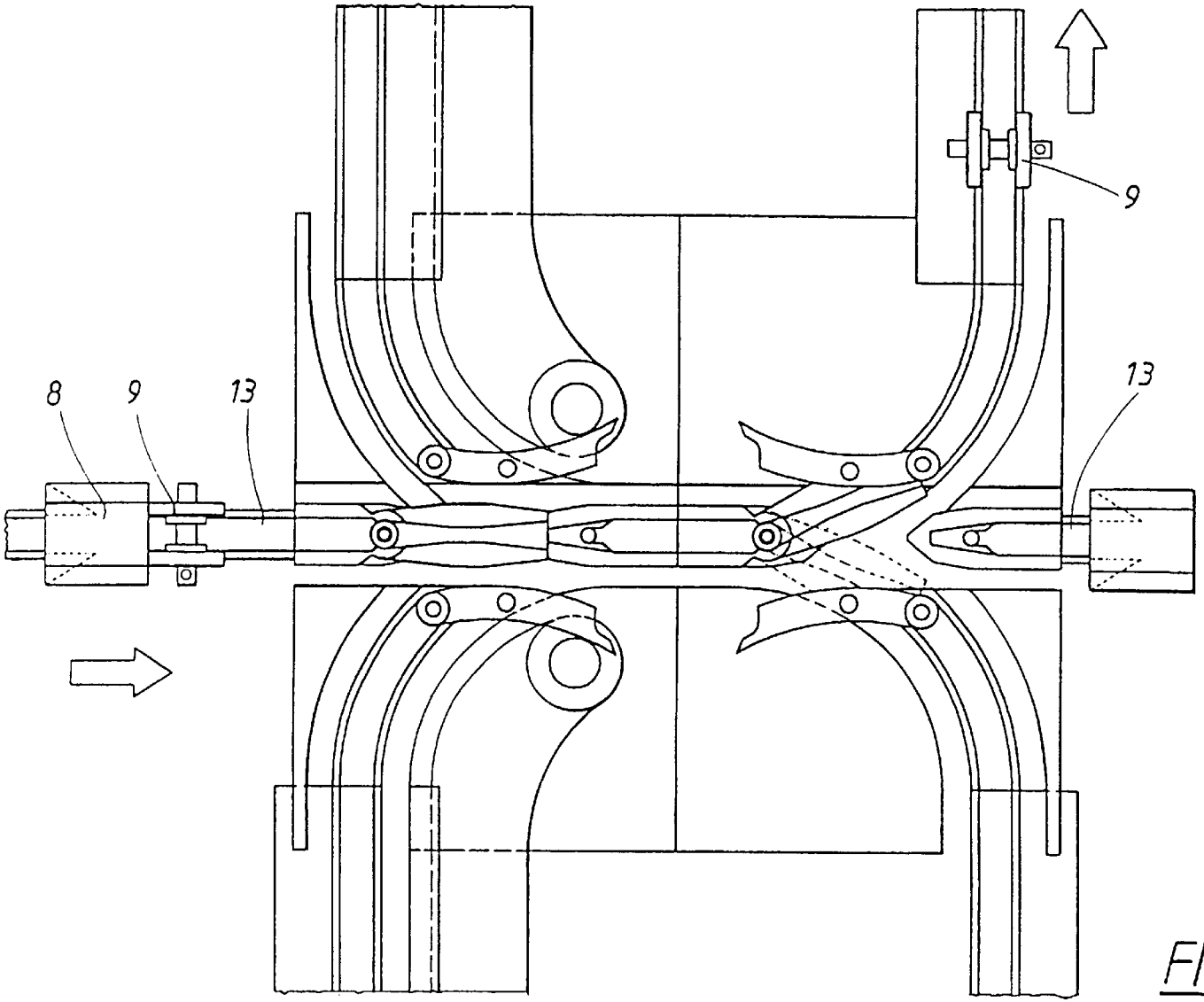
FIG. 7 is a top, elevational, partially schematic view as shown in FIG. 3, demonstrating how branches can be obtained on both sides of the main rail.

FIG. 7 shows the same arrangement as in FIGS. 3–6 but, as appears in this case, feeding in to the main rail 13 and removal from the main rail 13 from both sides has been arranged. The arrangement according to FIG. 7 however works in the same way as the arrangements according to FIGS. 3–6.

Figure 8:
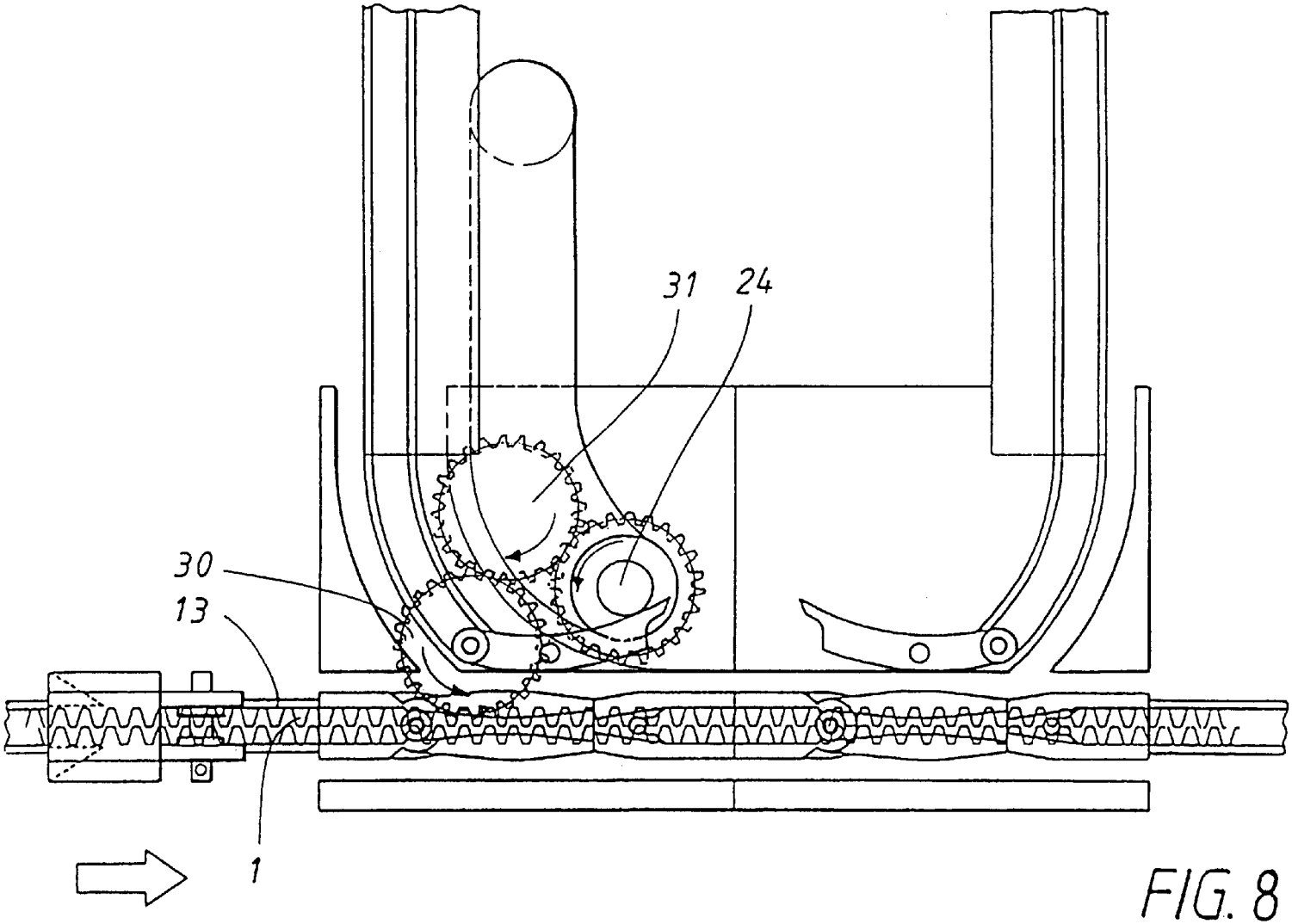
FIG. 8 is a top, elevational, partially schematic view as shown in FIG. 3, demonstrating the carrier band for the side chain being driven by the main band.

Finally, FIG. 8 shows how the driving band 1 is arranged above the main rail 13. A cog-wheel 30 which is driven by the band 1 engages the band 1. This cog-wheel 30 drives the driving-wheel 24 through a coupling 31, which couples the driving-wheel 24 to the wheel 30 driven by the band 1 when the barrier for feeding into the main rail 13 is released.

By having access to the driving band 1 from both sides at any place along its long track, branch rails can be arranged in an arbitrary manner along the entire track. Driving of the driving band 1 may also occur with many synchronized motors each of which can be weak, since they together pull the band around. This is also very important for reasons of security, since if the band is held up near one motor this will stop and when this stops all motors are influenced by means of the security arrangements so that the whole band will stop. No unnecessary compression or extension of the band will therefore occur. This is also of importance bearing in mind that the band can be several hundred meters long.

An advantage with this open driving band is also that all branches can be driven by this band by means of change-over devices as shown above.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. Apparatus for feeding a plurality of product carriers comprising a first rail for said plurality of product carriers whereby said plurality of product carriers can move along said first rail, a plurality of branches associated with said first rail whereby said plurality of product carriers can be supplied to and removed from said first rail along said plurality of branches, an endless belt for moving said plurality of product carriers along said first rail, and a second rail disposed above said first rail, said endless belt including downwardly extending sides, and being suspended from said second rail whereby said downwardly extending sides of said endless belt are displaced below said second rail, which does not interfere with the accessibility of said endless belt for driving thereby.

2. The apparatus according to claim 1 wherein said downwardly extending sides of said endless belt include recesses, whereby said endless belt may be driven by cooperation of said recesses with a driving member.

3. The apparatus of claim 1 wherein said endless belt includes downwardly extending carrier means, whereby said plurality of product carriers can be moved along said first rail by means of said downwardly extending carrier means.

4. The apparatus of claim 1 wherein said plurality of branches includes at least one feeding-in branch for feeding at least one of said plurality of product carriers onto said first rail at a first point and at least one feeding-out branch for removing at least one of said plurality of product carriers from said first rail at a second point, and changeover means disposed at said first and second points, said changeover means including cog wheels driven by said endless belt for synchronizing said feeding of said at least one of said plurality of product carriers onto said first rail and said removing of said at least one of said plurality of product carriers from said first rail.

5. The apparatus of claim 4 including a first endless band for feeding said at least one product carrier onto said first rail and a second endless band for removing said at least one product carrier from said first rail, said cog wheels driving said first and second endless bands.

6. The apparatus of claim 5 wherein said first endless band is disposed adjacent to said at least one feeding-in branch and said first endless band includes a carrier member protruding from said first endless band towards said at least one feeding-in band for interacting with said at least one product carrier.

7. The apparatus of claim 6 wherein said carrier member plug shaped.

8. The apparatus of claim 1 including coupling means for coupling said first rail to at least one of said plurality of branches, said coupling means including at least one end piece associated with said at least one of said plurality of branches, said at least one end piece being swingable between a first position distal from said first rail and a second position proximate to said first rail whereby said plurality of product carriers can be supplied to or removed from said first rail when said at least one end piece is in said second position, and at least one intermediate first rail portion located on said first rail adjacent to said at least one end piece, said at least one intermediate first rail portion being swingable between a first position in line with said first rail when said at least one end piece is in said first position and a second position out of line with said first rail when said at least one end piece is in said second position.

9. The apparatus of claim 8 wherein said at least one of said plurality of branches comprises a feeding-in branch for feeding at least one of said plurality of product carriers to said first rail, whereby one of said plurality of product carriers moving along said first rail causes said at least one end piece and said at least one intermediate first rail portion to swing into said second position.

10. The apparatus of claim 8 wherein said at least one of said plurality of branches comprises a feeding-out branch for removing at least one of said plurality of product carriers from said first rail, and including adjustment means for swinging said at least one end piece into said second position, whereby one of said plurality of product carriers moving along said first rail causes said at least one intermediate rail portion and said at least one end piece to swing into said first position.

11. Apparatus for feeding a plurality of product carriers comprising a first rail for said plurality of product carriers whereby said plurality of product carriers can move along said first rail, a plurality of branches associated with said first rail whereby said plurality of product carriers can be supplied to and removed from said first rail along said plurality of branches, said plurality of branches including at least one feeding-in branch for feeding at least one of said plurality of product areas onto said first rail at a first point and at least one feeding-out branch for removing at least one of said plurality of product carriers from said first rail at a second point, an endless belt for moving said plurality of product carriers along said first rail, a second rail disposed above said first rail, said endless belt including downwardly extending sides, and being suspended from said second rail whereby said downwardly extending sides of said endless belt are accessible for driving of said endless belt thereby, and changeover means disposed at said first and second points, said changeover means including cartwheels driven by said endless belt for synchronizing said feeding of said at least one of said plurality of product carriers onto said first rail and said removing of said at least one of said plurality of product carriers from said first rail.

12. The apparatus of claim 11, including a first endless band for feeding said at least one product carrier onto said first rail and a second endless band for removing said at least one product carrier from said first rail, said cog wheels driving said first and second endless bands.

13. The apparatus of claim 12, wherein said first endless band is disposed adjacent to said at least one feeding-in branch and said first endless band includes a carrier member protruding from said first endless band towards said at least one feeding-in band for interacting with said at least one product carrier.

14. The apparatus of claim 13, wherein said carrier member is plug shaped.

15. Apparatus for feeding a plurality of product carriers comprising a first rail for said plurality of product carriers whereby said plurality of product carriers can move along said first rail, a plurality of branches associated with said first rail whereby said plurality of product carriers can be supplied to and removed from said first rail along said plurality of branches, an endless belt for moving said plurality of product carriers along said first rail, a second rail disposed above said first rail, said endless belt including downwardly extending sides, and being suspended from said second rail whereby said downwardly extending sides of said endless belt are accessible for driving of said endless belt thereby, coupling means for coupling said first rail to at least one of said plurality of branches, said coupling means including at least one end piece associated with said at least one of said plurality of branches, said at least one end piece being swingable between a first position distal from said first rail and a second position proximate to said first rail whereby said plurality of product carriers can be supplied to or removed from said first rail when said at least one end piece is in said second position, and at least one intermediate first rail portion located on said first rail adjacent to said at least one end piece, said at least one intermediate first rail portion being swingable between a first position in line with said first rail when said at least one end piece is in said first position and a second position out of line with said first rail when said at least one end piece is in said second position.

16. The apparatus of claim 15 wherein said at least one of said plurality of branches comprises a feeding-in branch for feeding at least one of said plurality of product carriers to said first rail, whereby one of said plurality of product carriers moving along said first rail causes said at least one end piece and said at least one intermediate first rail portion to swing into said second position.

17. The apparatus of claim 15 wherein said at least one of said plurality of branches comprises a feeding-out branch for removing at least one of said plurality of product carriers from said first rail, and including adjustment means for swinging said at least one end piece into said second position, whereby one of said plurality of product carriers moving along said first rail causes said at least one intermediate rail portion and said at least one end piece to swing into said first position.

* * * * *